US005660060A

United States Patent [19]

Catanzaro

[11] Patent Number: 5,660,060

[45] Date of Patent: Aug. 26, 1997

[54] METHOD AND APPARATUS FOR ATTACHING A FINDING TO AN ARTICLE OF JEWELRY

[75] Inventor: Robert S. Catanzaro, East Greenwich, R.I.

[73] Assignee: Ultralite Technology Incorporated, Providence, R.I.

[21] Appl. No.: 557,616

[22] Filed: Nov. 14, 1995

[51] Int. Cl.[6] ..... A44C 7/00

[52] U.S. Cl. ..... 63/12; 63/13; 63/DIG. 3

[58] Field of Search ..... 63/2, 12, 13, 20, 63/21, 23, DIG. 3; 29/896.4, 896.41

[56] References Cited

U.S. PATENT DOCUMENTS 4,630,452 12/1986 Connelly et al. ..... 63/12
4,781,036 11/1988 Erickson ..... 63/12
5,437,166 8/1995 Gardner ..... 63/12

FOREIGN PATENT DOCUMENTS 583538 10/1958 Italy ..... 63/DIG. 3

*Primary Examiner*—Kien T. Nguyen
*Attorney, Agent, or Firm*—Salter & Michaelson

[57] ABSTRACT

A method for attaching a finding having a leg portion, to an article of jewelry having an outer shell, includes securing the finding to a device constructed and arranged for holding the finding, applying vibrational forces to the device so as to cause the finding to vibrate, and press fitting the leg portion of the finding into the opening of the article of jewelry. The vibrational movement of the finding facilitates the insertion of the leg portion of the finding into the opening of the shell of the article and reduces the amount of force required. The resin material within the shell of the article assists in securing the leg portion of the finding in place. An apparatus used in performing the method is further disclosed.

3 Claims, 6 Drawing Sheets

METHOD AND APPARATUS FOR ATTACHING A FINDING TO AN ARTICLE OF JEWELRY

BACKGROUND AND SUMMARY OF THE INVENTION

This invention relates generally to methods and apparatuses for attaching findings to an article of jewelry, and more particularly to an improved method which utilizes a uniquely shaped finding and vibration for securing the finding to the article.

In the gold jewelry industry, articles of gold and silver jewelry are frequently made from a gold or silver electroform process used in connection with hollow articles. This is because articles made from solid gold and silver are too expensive for most consumers. The conventional method of attaching a finding, such as an earring post, joint member (e.g., a movable joint and catch), or the like, to the article of jewelry requires the finding to be soldered to the article. It is especially difficult to solder findings to articles of jewelry made by the electroforming process since the walls of the article are thin and are not particularly suited for soldering.

If soldered, such pieces often require soft solder instead of the preferred hard solder because the hard solder has a melting point of approximately 600° F. which is too hot and destroys the thin walls of the article. The heat used to solder the finding to the article has a tendency to anneal the thin walls of the hollow article which are subjected to the heat around the area of attachment thereby causing the walls to be brittle. Soft solder, which melts at approximately 200° F., is also undesirable since it reduces the percentage of precious metal (e.g., silver) in the piece.

This method further suffers from the disadvantage that the finding is subject to breaking away from the article, especially when the surface area(s) at the point(s) of attachment of the finding to the article is (are) relatively small. Thus, articles having findings attached thereto by soldering have high rejection rates thereby increasing the manufacturing costs associated with producing the articles.

Another method of attachment is by using cement or glue. This method suffers from the fact that it does not provide a positive, secure attachment of the finding to the ornament. Thus, articles made by attaching the finding to the article with cement are also subject to high rejection rates.

Another known method involves securing the finding in a fixture and press-fitting by hand the finding into an opening formed in the article of jewelry. This method has several drawbacks, including that it takes a significant amount of hand strength to press fit the finding into the opening formed in the article of jewelry. Moreover, the findings, since they are relatively thin and pliable, have a tendency to bend or break when being forced into the opening of the article. Thus, rejection rates of articles manufactured by this method is also relatively high.

The foregoing illustrates limitations known to exist in present methods of attaching findings to articles of jewelry. Thus, it is apparent that it would be advantageous to provide an alternative method directed to overcoming one or more of the limitations set forth above. Accordingly, a suitable alternative is provided including features more fully disclosed hereinafter.

Among the several objects of the present invention are the provision of an improved method and apparatus for attaching a finding to an article of jewelry which positively and securely attaches the finding in a superior manner than prior methods and apparatuses; the provision of such an improved method and apparatus which produce an article of jewelry having a neat, attractive appearance; the provision of such an improved method and apparatus which do not require soldering of the article; the provision of such an improved method and apparatus which decrease the rejection rate of the articles; and the provision of such an improved method and apparatus which are easy to perform and use.

Also among the several objects of the present invention is to provide an improved finding which is uniquely configured so as to increase the strength of securement of the finding to the article of jewelry.

The instant invention provides an improved method for attaching a finding having a leg portion, to an article of jewelry having an outer shell, a hollow interior region filled with resin material, and at least one opening formed in the shell which is in communication with the interior region wherein the opening is sized to slightly interfere with the leg portion when attempting to insert the leg portion of the finding into the opening of the shell of the article. The method comprises the steps of: (a) securing the finding to a device constructed and arranged for holding the finding; (b) applying vibrational forces to the device so as to cause the finding to vibrate; and (c) press fitting the leg portion of the finding into the opening of the article of jewelry. The vibrational movement of the finding facilitates the insertion of the leg portion of the finding into the opening of the shell of the article and reduces the amount of force necessary to press fit the finding to the article. The resin material within the shell of the article further assists in securing the leg portion of the finding in place.

The method of the present invention is achieved by an apparatus comprising a jig having means for holding the finding in a position where the leg portion of the finding extends outwardly away from the jig, and means for vibrating the jig for vibrating the finding so as to facilitate the insertion of the leg portion of the finding into the opening of the shell of the article.

More specifically, the holding means of the jig comprises a tool clamping assembly that is mountable on a surface, and a tool which is releasably attachable to the tool clamping assembly. The tool is constructed and arranged for receiving a specific finding having a predetermined shape. The clamping assembly comprises a stand portion and a pair of clamping members having vice means for drawing the clamping members together. The arrangement is such that the tool is placed between the clamping members which are drawn together by the vice means for securing the tool in place. The clamping assembly further comprises a spring for further securing the clamping members together.

The vibrating means of the apparatus further comprises any suitable device that imparts vibration, such as a conventional engraving machine and means for selectively operating the engraving machine. The operating means comprises a foot pedal in electrical communication with the engraving machine.

In another aspect of the present invention the finding comprises a leg portion having ridges formed thereon. The ridges are engaged by the resin material so as to assist in preventing the removal of the finding from the article.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
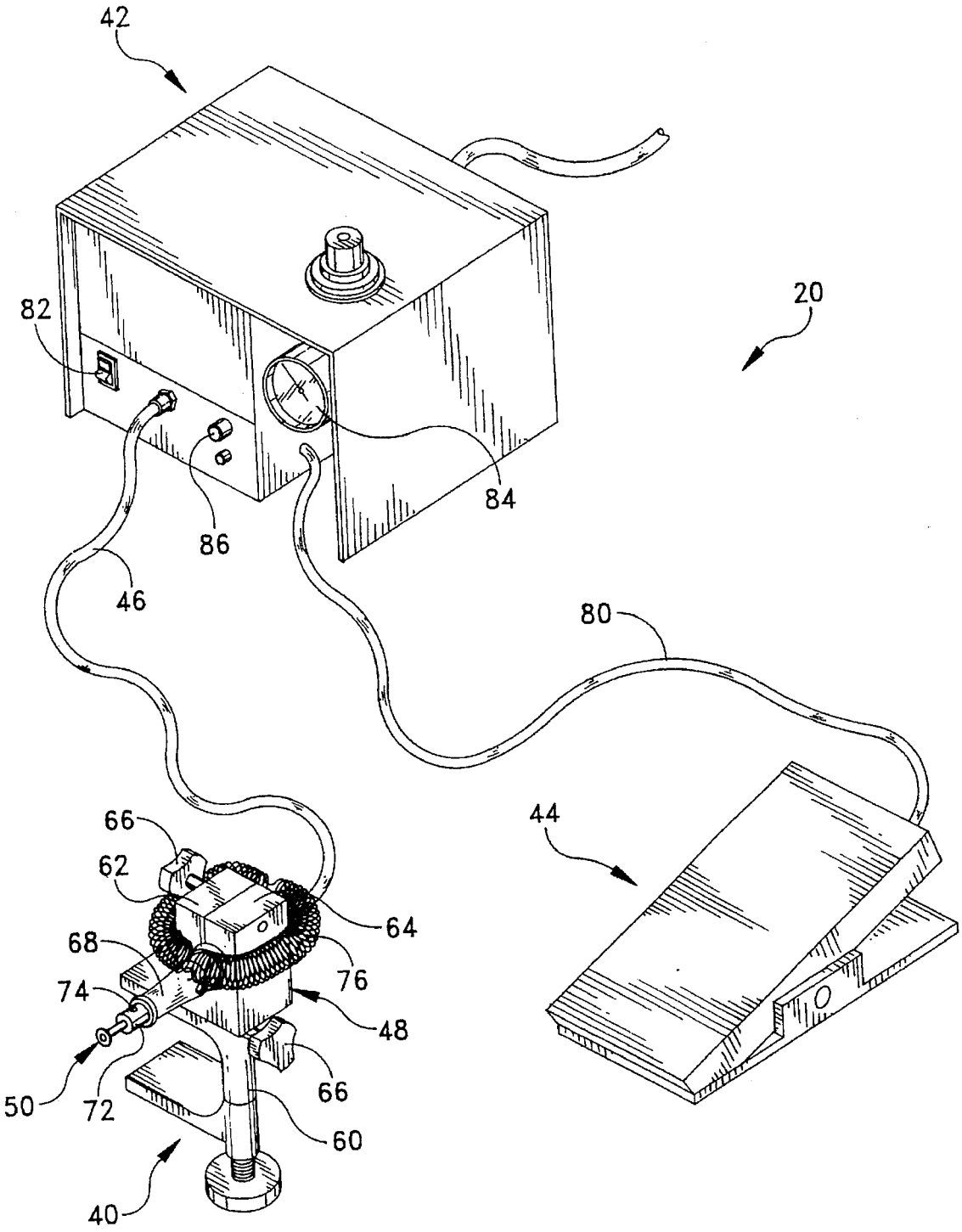
FIG. 1 is a perspective view of an apparatus of the present invention for attaching a finding to an article of jewelry.
Figure 2:
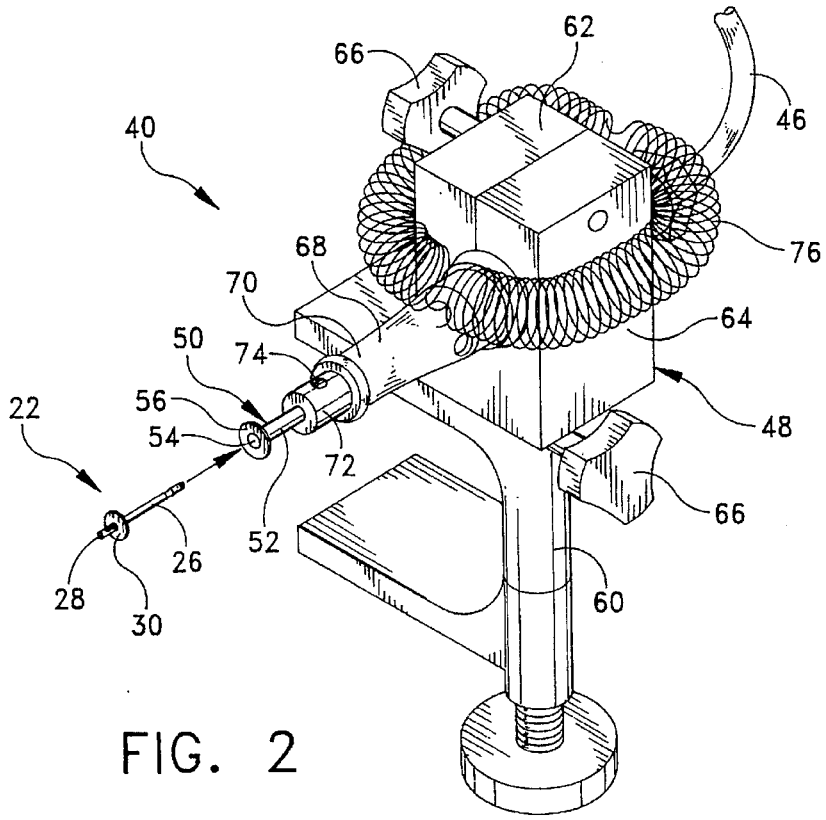
FIG. 2 is a perspective view of a jig of the apparatus adapted for securing a finding in the form of an earring post thereto.
Figure 4:
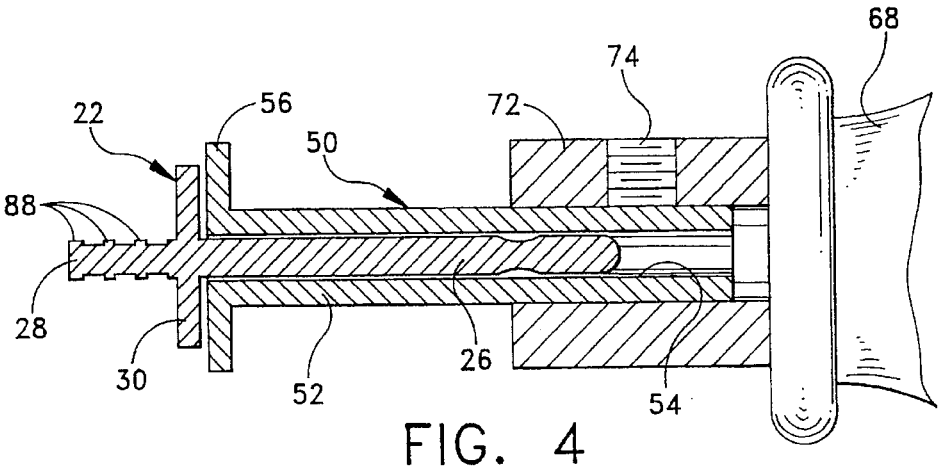
FIG. 4 is an enlarged cross-sectional view taken along line 4—4 of FIG. 3.
Figure 5:
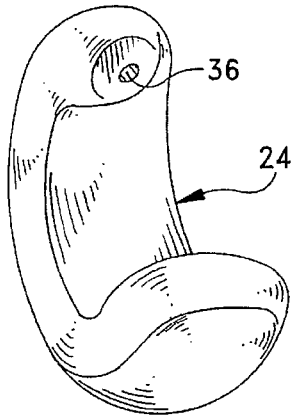
FIG. 5 is a perspective view of an article of jewelry.

Referring now to the drawings, and particularly to FIGS. 1, 2 and 5, there is generally indicated at 20 an apparatus of the present invention for attaching a finding, generally indicated at 22 in FIG. 2, to an article of jewelry, generally indicated at 24 in FIG. 5. As illustrated in FIG. 2, the finding 22 has a body portion 26 in the form of a post for a conventionally constructed earring used for pierced ears, and a leg portion 28 separated from the body portion 26 by a flange 30. As shown in FIG. 4, the flange has a diameter at least two times as large as the diameters of the body portion and leg portion. Preferably, the finding 22 is fabricated from either surgical steel, sterling silver, brass, phosphorous bronze, and 14 k or 10 k gold, and made by a progressive tool arrangement.

Figure 6:
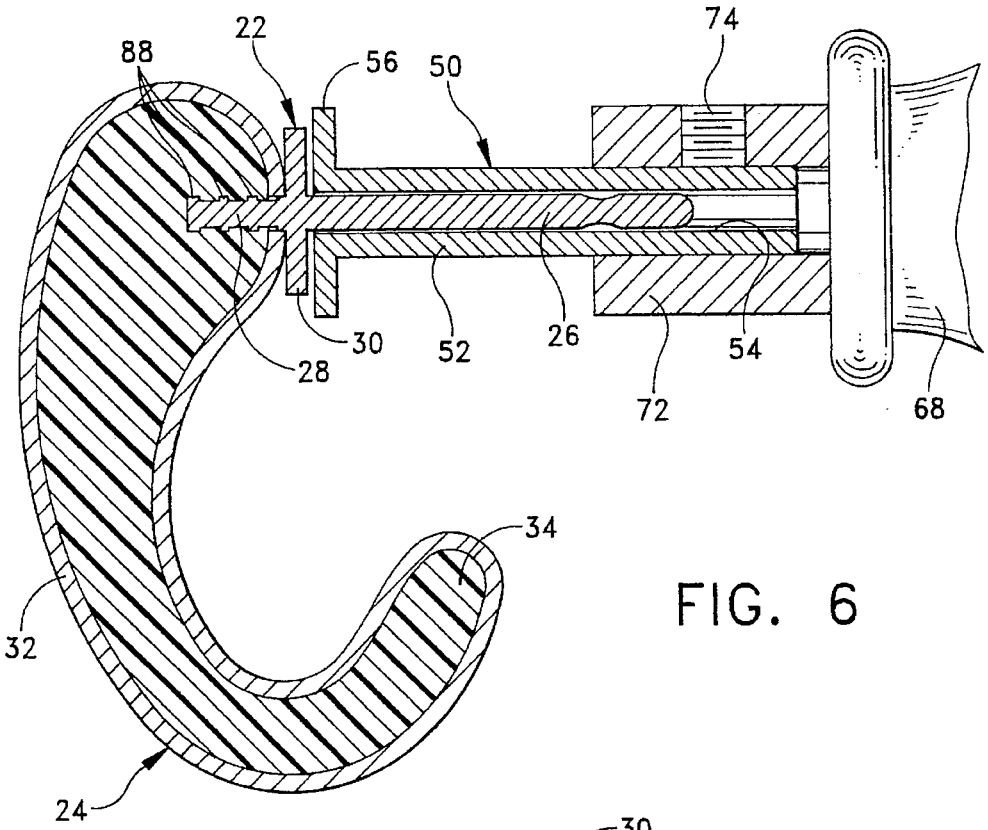
FIG. 6 is an enlarged cross-sectional view similar to FIG. 4 illustrating the finding being attached to the article of jewelry.
Figure 7:
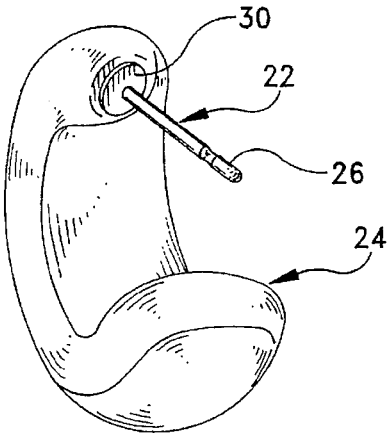
FIG. 7 is a perspective view of a finished article of jewelry.

Turning to FIGS. 5–7, the article of jewelry 24 of the present invention is made from a gold, silver or copper electroform process. This is because articles made from either solid gold and silver are too expensive for most consumers and the hollow construction afforded by electroforming substantially reduces the mass of the article and therefore its cost. The article 24 includes an outer wall or shell 32 which defines a hollow interior region (see FIG. 6). The interior region of the shell 32 is filled with suitable resin material 34 (e.g., any suitable polymer) which gives the article 24 some strength and rigidity for making it more durable and less likely to break. At least one opening 36 (see FIG. 5) is formed in the shell 32 which is in communication with the interior region of the article 24. The opening 36 is sized to slightly interfere with the leg portion 28 of the finding 22 when attempting to insert the leg portion 28 into the opening 36 of the shell 32. FIG. 7 illustrates the finding 22 having the body portion in the form of a post attached to the article 24 (e.g., an earring).

The apparatus 20 of the present invention is provided for facilitating the attachment of the finding 22 to the shell 32 of the article of jewelry 24. Turning back to FIG. 1, the apparatus 20 comprises a jig, generally indicated at 40, an engraving machine, generally indicated at 42, for causing the vibrational movement of the jig 40, and means for selectively operating the engraving machine embodying a foot pedal, generally indicated at 44. The arrangement is such that the engraving machine 42 produces vibratory forces which are transferred to the jig 40 via a flexible cable 46 for vibrating the finding 22 which is housed by the jig 40. The vibration of the finding 22 facilitates the insertion of the leg portion 28 of the finding 22 into the opening 36 of the shell 32. It has been discovered that by vibrating the finding 22, less force is required to press fit the leg portion 28 of the finding 22 into the opening 36 of the shell 32. Prior art methods of press fitting a finding to an article of jewelry require a greater amount of force which, depending upon the strength of the person assembling the article, and the rigidity of the leg portion of the finding, causes frequent deformations of the findings resulting in increased rejection rates.

Figure 3:
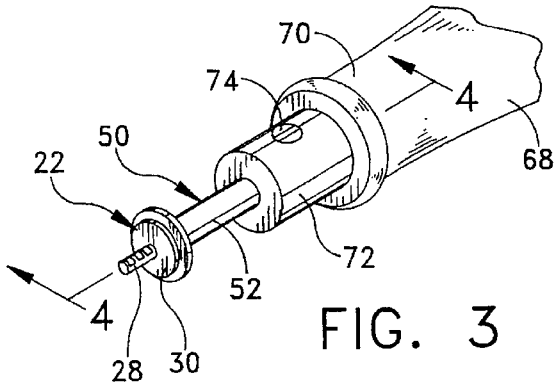
FIG. 3 is an enlarged perspective view of a portion of the jig.

Turning now to FIGS. 2–7 and more particularly to FIGS. 2–4, the jig 40 of the apparatus 20 comprises means for holding the finding 22 in a position where the leg portion 28 extends outwardly away from the jig 40 embodying a tool clamping assembly generally indicated at 48 that is mounted on a horizontal surface (e.g., a table top) and a tool generally indicated at 50 which is releasably attachable to the tool clamping assembly 48. As shown, the tool 50 is constructed and arranged for receiving the finding 22 therein. The tool 50 illustrated in these views comprises an annular wall 52 having an elongate bore 54 formed therein and a circumferential end flange 56. For the finding 22 illustrated in these drawings, the body portion 26 (i.e., the post) of the finding 22 is received in the bore 54 of the tool 50 in a position where the body portion 26 is nearly completely received within the bore 54 and the flange 30 of the finding 22 engages the end flange 56 of the tool 50 (see FIG. 4).

The clamping assembly 48 comprises a stand device 60 which is capable of being attached to an edge of a table or work bench, for example, in the conventional manner, and a pair of complementary clamping members 62, 64 having vice means in the form of a pair of thumb turn screws or knobs, each indicated at 66, for drawing the clamping members 62, 64 together. The clamping members 62, 64 secure a tool receiving member 68 (see FIG. 4) thereto, and clamps the member 68 to the stand device 60 by turning the knobs 66 in the appropriate direction such that the members 62, 64 are drawn towards one another. The tool receiving member 68 has one end (not designated) attached to the flexible cable 46 of the engraving machine 42, and an opposite end 70 with a chuck portion 72 which is adapted to receive the tool 50 therein. A screw 74 is provided for securing the tool 50 to the chuck portion 72 (see FIG. 4). Any other suitable method for mounting the tool 50 to the chuck portion 72 can be used as well. A spring 76 is provided for further securing the clamping members 62, 64 together and for assisting in the transfer of the vibration forces from the flexible cable 46, to the tool receiving member 68, to the tool 50 and finally to the finding 22. The spring 76 provides extra holding strength and stabilizes the clamping assembly 48.

The engraving machine 42, which is of the type sold by GRS Corporation of Emporia, Kan. under the trademark "GraverMate", provides the vibrational forces necessary to vibrate the jig 40 and thus the finding 22 held therein. As illustrated in FIG. 1, the foot pedal 44 is in electrical or pneumatic communication with the engraving machine by line 80. The arrangement is such that by pressing the foot pedal 44, the engraving machine 42 is activated and vibrational movement is delivered to the jig 40. The engraving machine 42 has an on/off rocker switch 82 which is illuminated when the switch 82 is turned to its "on" position. A pressure gauge 84 is provided on the engraving machine 42 for reading the pressure of the flexible cable 46. It has been discovered that a pressure setting of 30 psi for the above-identified engraving machine provides the optimal amount of vibrational movement for assisting the person assembling the finding 22 with the article of jewelry 24 to press fit the leg portion 28 of the finding 22 into the opening 36 of the shell 32. A rotatable knob 86 is further provided for varying the pressure.

For strengthening the attachment of the finding to the article of jewelry, ridges 88 are formed on the leg portion 28 of the finding 22 which are engaged by the resin material 34 within the interior region of the shell 32 so as to assist in preventing the removal of the finding 22 from the shell 32. Resistance is also provided by the fact that the leg portion 28 has a slightly greater circumference than the diameter of the opening 36 in the shell 32 thereby resulting in a slight interference fit. FIG. 6 clearly illustrates the ridges 88 of the leg portion 28 and the interposition of the resin material 34 between the ridges 88. Prior art findings lack the ridges 88 of the present invention and typically have a smooth leg which enter the opening in the shell of the article, therefore providing no resistance to any force which results in the unwanted removal of the finding from the article. FIG. 7 illustrates the completed article of jewelry 24 with the finding 22 securely attached to the shell 32.

Figure 8:
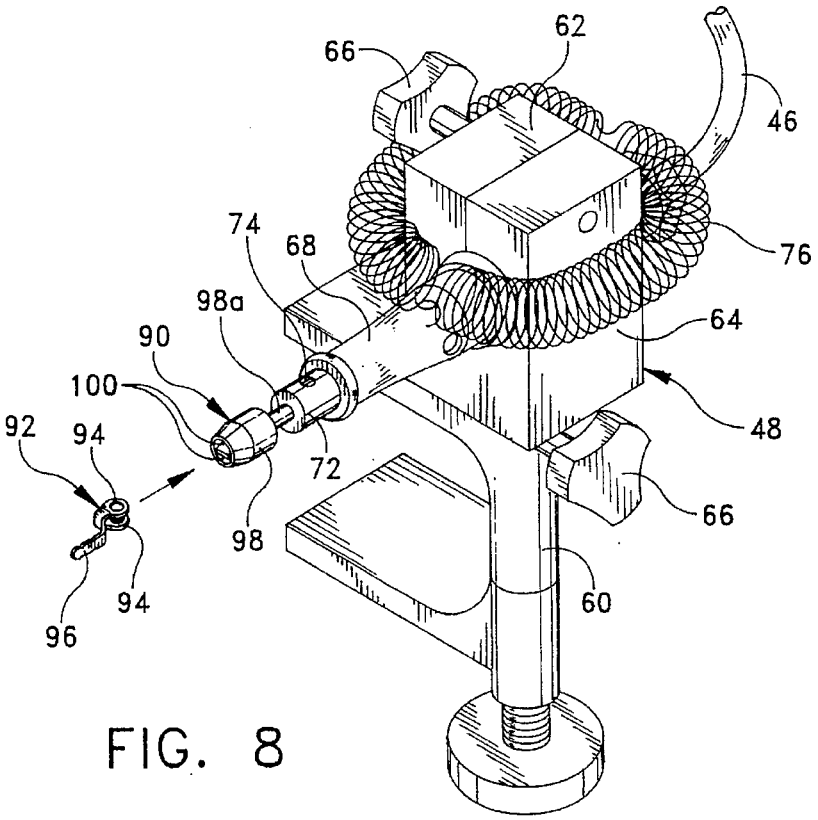
FIG. 8 is a perspective view of the jig of the apparatus adapted for securing a finding in the form of a joint member thereto.
Figure 9:
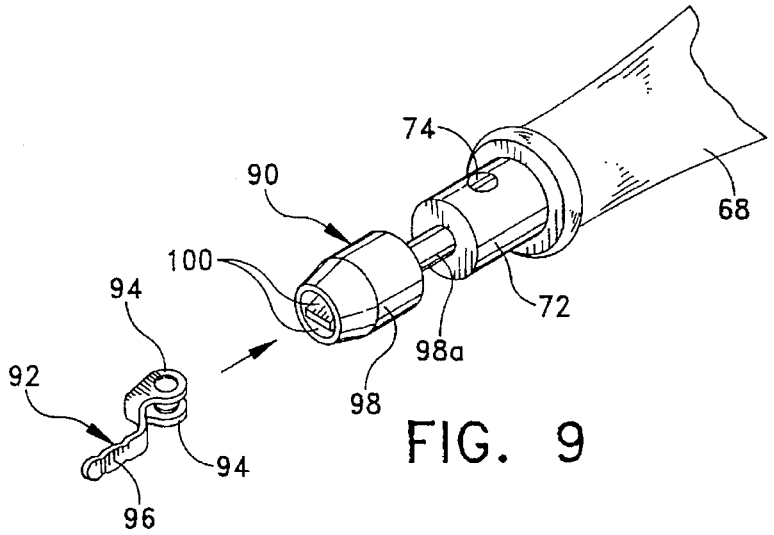
FIG. 9 is an enlarged perspective view of the jig illustrated in FIG. 8.
Figure 10:
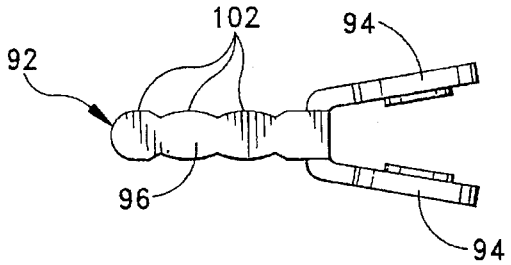
FIG. 10 is an enlarged view of the joint member.

Referring now to FIGS. 8–10, there is generally indicated at 90 a tool constructed and arranged for receiving a different form of finding generally indicated at 92 in the shape of an earring joint member. The finding 92 has a body portion having a pair of laterally spaced apart elements 94 and an oppositely extending leg portion 96. The tool 90, which is best illustrated in FIG. 9, has a body 98 with a reduced diameter portion 98*a*, and a pair of elongate slots 100 formed in the body 98 which receives the laterally spaced apart elements 94 of the finding 92 for securely holding the finding 92 to the tool 90. The reduced diameter portion 98*a* is secured to the chuck 72 in an identical manner as tool 50. As illustrated in FIG. 10, the finding 92 is also formed with ridges 102 on the leg portion 96 which substantially prevent the removal of the finding 92 from an article of jewelry (generally indicated at 104 in FIG. 14) after its attachment thereto. The finding 92 is attached to the article 104 in the same manner that the finding 22 of FIGS. 1–7 is attached to shell 32.

Figure 11:
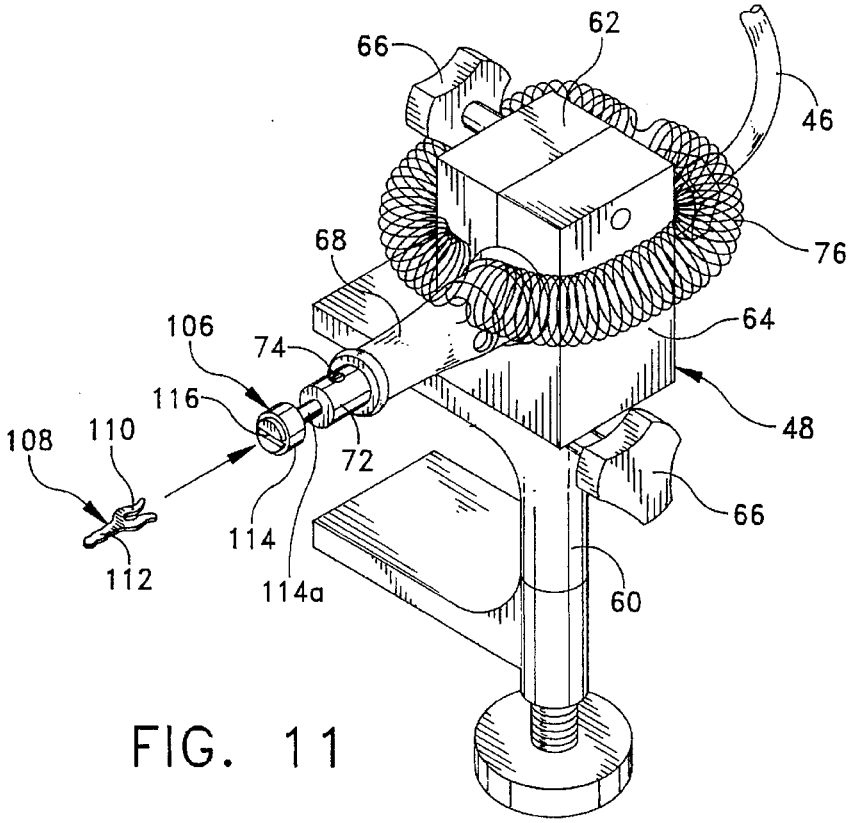
FIG. 11 is a perspective view of the jig of the apparatus adapted for securing a finding in the form of a catch thereto.
Figure 12:
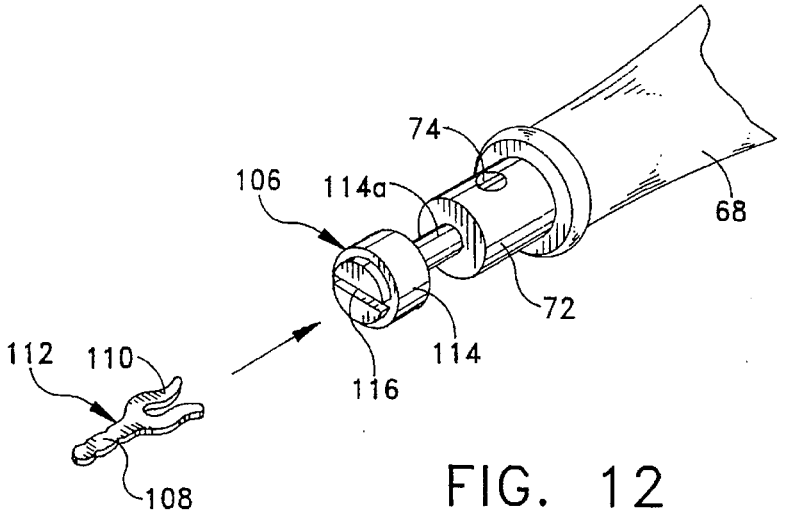
FIG. 12 is an enlarged perspective view thereof.
Figure 13:
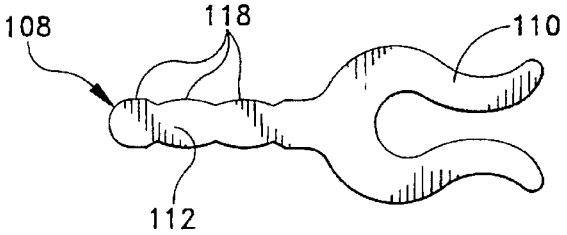
FIG. 13 is an enlarged view of the catch.

Referring now to FIGS. 11–13, there is generally indicated at 106 a tool constructed and arranged for receiving still another type finding generally indicated at 108 in the shape of a catch. This finding has a U-shaped body portion 110 and an oppositely extending leg portion 112. The tool 106, which is best illustrated in FIG. 12, has a body 114 with a reduced diameter portion 114*a*, and elongate slot 116 formed in the body 114 which receives the U-shaped body portion 110 of the finding 108 for securely holding the finding 108 to the tool 106. The reduced diameter portion 114*a* is secured to the chuck 72 as shown. As illustrated in FIG. 13, the leg portion 112 of the finding 108 is also formed with ridges 118 which substantially prevent the removal of the finding 108 from the article of jewelry 104 (see FIG. 14) after its attachment thereto.

Figure 14:
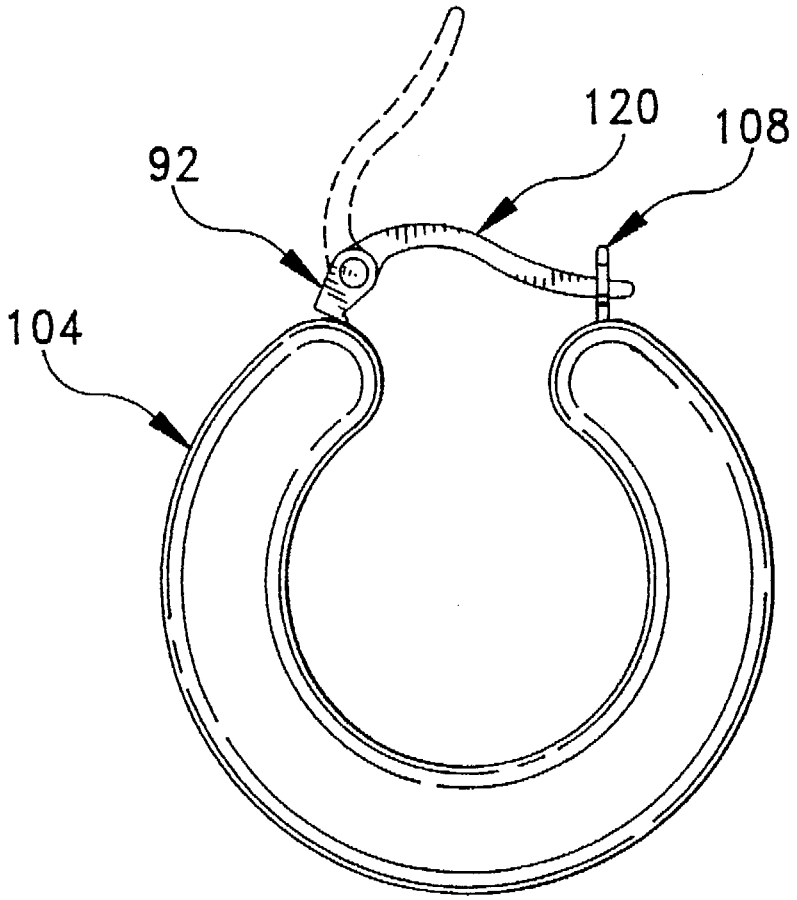
FIG. 14 is an elevational view of an earring having the joint member and catch attached thereto.

FIG. 14 shows the article of jewelry 104, which is a hoop earring, after the attachment of the joint member finding 92 and catch finding 108 thereto. As shown, a post 120 is suitably attached to the elements 94 of the joint member 92 so as to permit the desired pivotal movement of the post.

The method of attaching the findings 22, 92 and 108 to their respective articles of jewelry 24, 104 involves the steps of securing a finding 22, 92 or 108 to the jig 40 having the requisite tool (e.g., tool 50, 90 or 106) for holding the finding, pressing the foot pedal 44 so as to activate the engraving machine 42 for applying vibrational forces to the jig 40 so as to cause the finding to vibrate, and press fitting by hand the leg portion of the finding into the opening formed in the shell of the article of jewelry. By following these steps, the leg portion of the finding is easily inserted into the shell of the article since the vibration of the finding reduces the amount of force required to press fit the leg portion into the shell. The resin material within the interior region of the shell additionally secures the leg portion of the finding in place, which securement is enhanced by the ridges provided in the leg portions of the findings.

While there is shown and described herein certain specific structure embodying the invention, it will be manifest to those skilled in the art that various modifications and rearrangements of the parts may be made without departing from the, spirit and scope of the underlying inventive concept and that the same is not limited to the particular forms herein shown and described except insofar as indicated by the scope of the appended claims.

What is claimed is:

1. A finding which is adapted to be attached to an article of jewelry having an outer shell, a hollow interior region filled with resin material, and at least one opening formed in the shell, said finding being fabricated from metallic material and comprising an elongate body portion which defines a post of the finding, a flange, and a leg portion separated from the body portion by said flange, said leg portion being sized to slightly interfere with the opening of the shell of the article when attempting to insert the leg portion of the finding into the opening of the shell, said leg portion having a plurality of ridges formed thereon, said ridges being engaged by the resin material so as to assist in preventing the removal of the finding from the article.

2. A finding as set forth in claim 1, said flange having a diameter at least two times as large as the diameters of the body portion and leg portion.

3. An article of jewelry comprising:

an ornamental body jewelry having an outer shell, a hollow interior region filled with resin material, and at least one opening formed in the shell; and a finding fabricated from metallic material and comprising an elongate body portion which defines a post of the finding, a flange, and a leg portion separated from the body portion by said flange, said leg portion being sized to slightly interfere with the opening of the shell of the article when attempting to insert the leg portion of the finding into the opening of the shell, said leg portion having a plurality of ridges formed thereon, said ridges being engaged by the resin material so as to assist in preventing the removal of the finding from the article.

* * * * *